US007007959B1

(12) United States Patent
Lu

(10) Patent No.: US 7,007,959 B1
(45) Date of Patent: Mar. 7, 2006

(54) BASE STRUCTURE OF A WALKER USED BY BABIES TO LEARN TO WALK

(76) Inventor: Li-Wei Lu, No. 59-16, Chiu-She Lane, Chiu She Li, Pei Tun District, Taichung City (TW)

( * ) Notice: Subject to any disclaimer, the term of this patent is extended or adjusted under 35 U.S.C. 154(b) by 79 days.

(21) Appl. No.: 10/705,001

(22) Filed: Nov. 12, 2003

(51) Int. Cl.
*B62B 7/00* (2006.01)

(52) U.S. Cl. ..... 280/87.051; 280/658; 280/47.38

(58) Field of Classification Search ..... 280/87.01, 280/87.021, 87.041, 87.051, 9, 10, 657, 658, 280/47.38, 30, 31; 297/5, 6
See application file for complete search history.

(56) References Cited

U.S. PATENT DOCUMENTS 4,093,208 A * 6/1978 Tomalinas, Jr. ..... 280/1.22
4,799,700 A * 1/1989 Knoedler et al. ..... 280/87.051
4,822,030 A * 4/1989 Cone ..... 280/87.051
D305,750 S * 1/1990 Cone ..... D12/130
5,104,134 A * 4/1992 Cone ..... 280/30
5,203,581 A * 4/1993 Jankowski ..... 280/87.051
5,230,523 A * 7/1993 Wilhelm ..... 280/30
D401,894 S * 12/1998 Cheng ..... D12/130
5,938,218 A * 8/1999 Chuang ..... 280/87.051

* cited by examiner

*Primary Examiner*—Christopher P. Ellis
*Assistant Examiner*—Brian Swenson
(74) *Attorney, Agent, or Firm*—Egbert Law Offices

(57) ABSTRACT

A walker used by babies to learn to walk includes a base frame on wheels. The base frame is provided with two rockers which are adjustably fastened to the base frame. The two rockers allow the walker a rocking movement. The two rockers are respectively fastened at a first retaining portion of the base frame when the two rockers remain in a standby state. The two rockers are respectively fastened at a second retaining portion of the base frame when the two rockers are at work.

3 Claims, 5 Drawing Sheets

BASE STRUCTURE OF A WALKER USED BY BABIES TO LEARN TO WALK

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a walker for use by babies who are learning to walk, and more particularly to a walker comprising a base, and rockers fastened to the base, so as to allow the walker to be used as a baby rocking chair.

BACKGROUND OF THE INVENTION

The conventional walkers comprise a frame on wheels for use by babies who are learning to walk. These conventional walkers are all similar in design in that they are used for only one type of activity. In another words, the conventional walkers are obsolete in terms of versatility.

BRIEF SUMMARY OF THE INVENTION

The primary objective of the present invention is to provide a versatile walker comprising a base on wheels. The base is provided with two rockers which are used to allow a rocking movement.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

As shown in FIGS. 1–8, a walker 05 embodied in the present invention comprises a base structure 10 which is capable of a back-and-forth movement on wheels 11 and a rocking movement on rockers 20.

Figure 1:
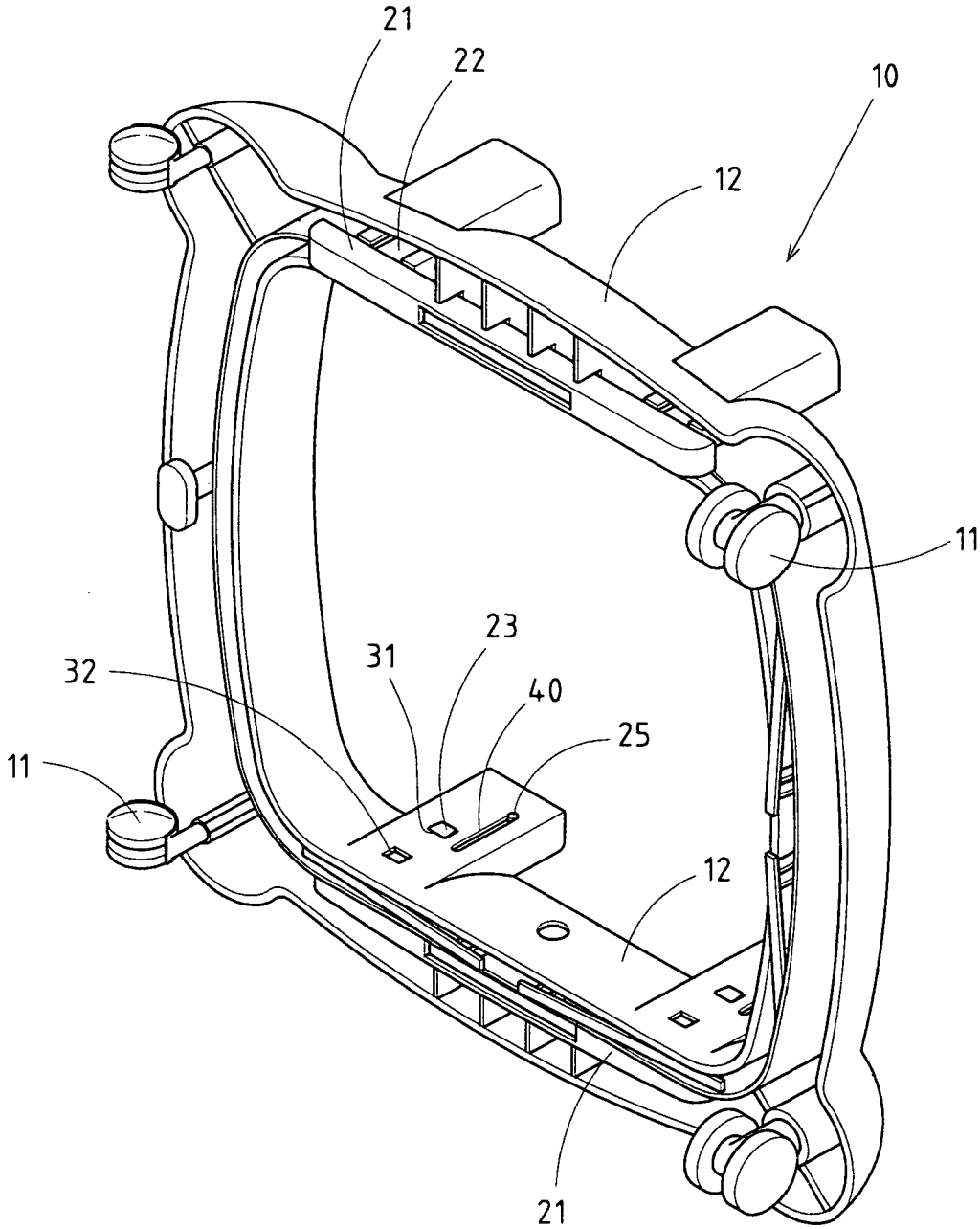
FIG. 1 shows a perspective view of a base structure of the preferred embodiment of the present invention.
Figure 2:
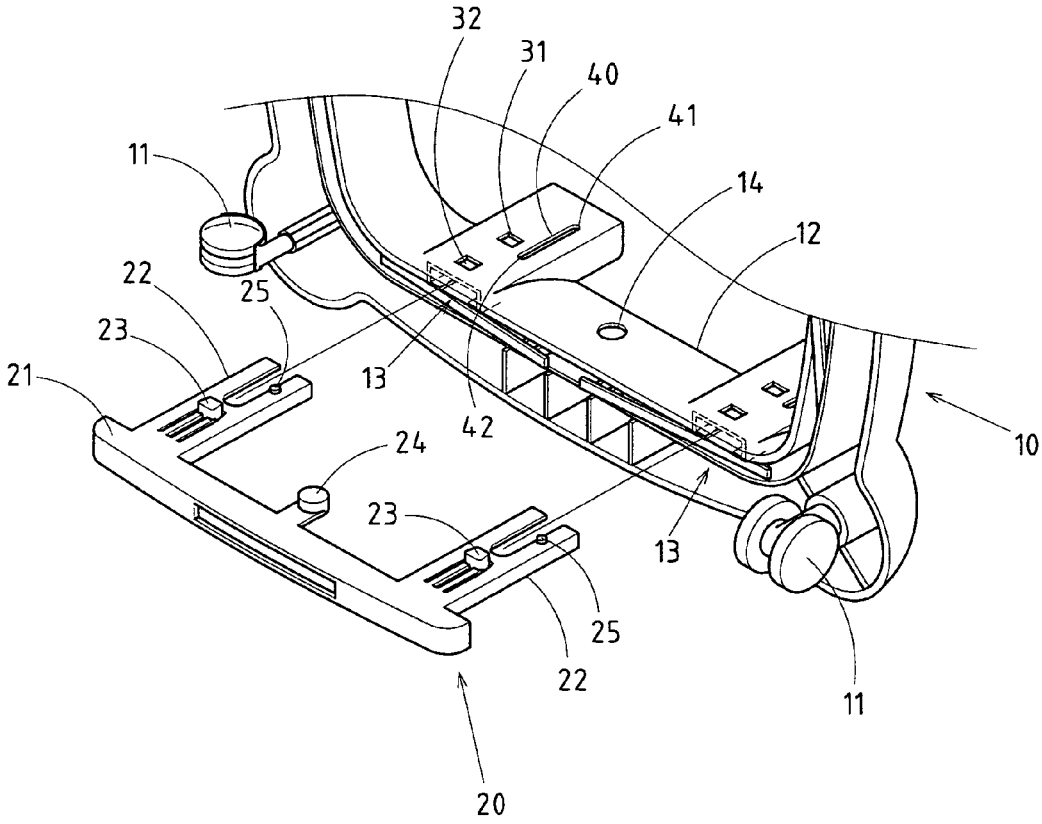
FIG. 2 shows an exploded perspective view of the base structure of the preferred embodiment of the present invention.
Figure 3:
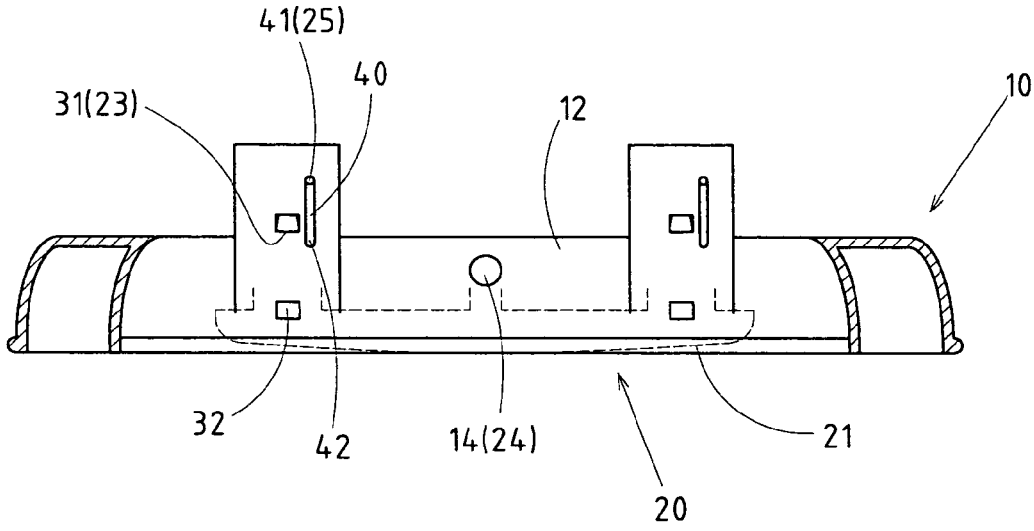
FIG. 3 shows a sectional schematic view of the base structure of the preferred embodiment of the present invention with rockers thereof being in the standby state.
Figure 4:
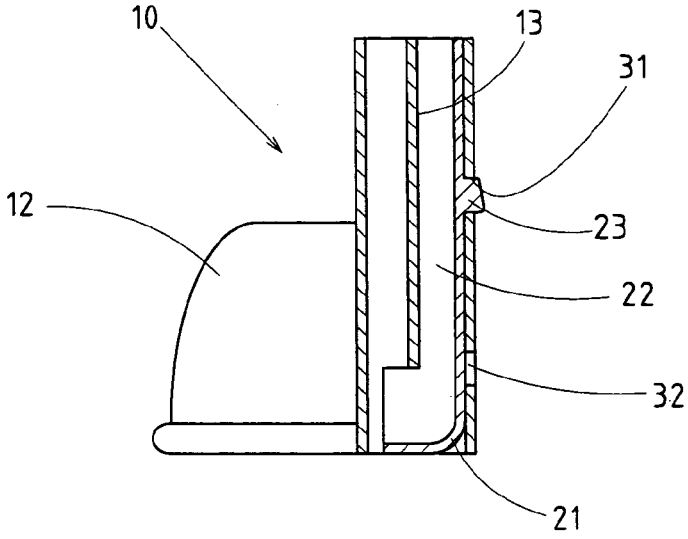
FIG. 4 shows a partial sectional schematic view of the base structure as shown in FIG. 3.
Figure 5:
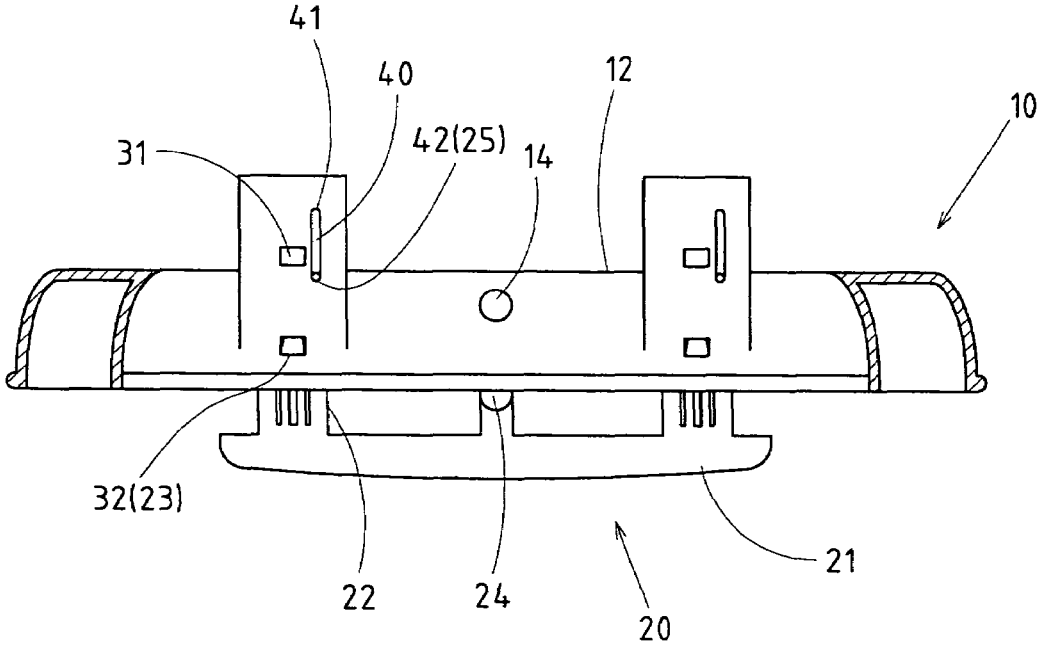
FIG. 5 shows a sectional schematic view of the base structure of the preferred embodiment of the present invention with rockers thereof being in the use state.
Figure 6:
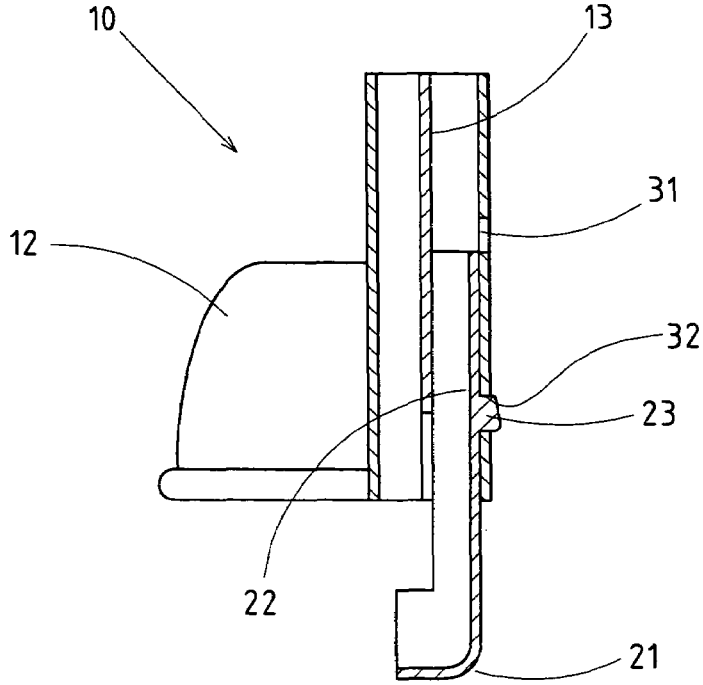
FIG. 6 shows a partial sectional schematic view of the base structure as shown in FIG. 5.
Figure 7:
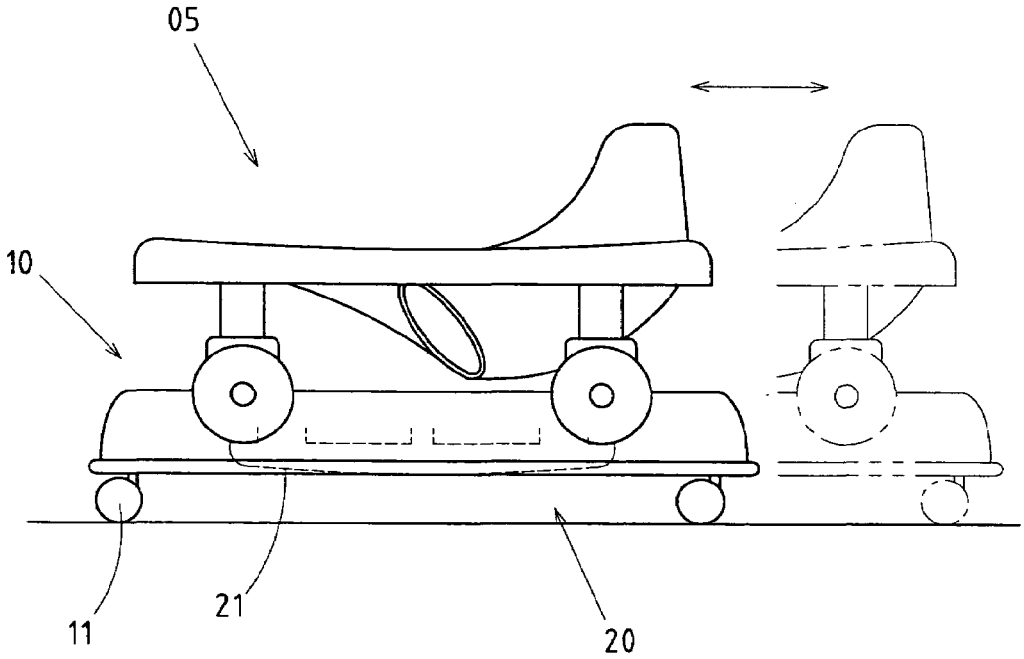
FIG. 7 shows a side schematic view of the preferred embodiment of the present invention in action on wheels.
Figure 8:
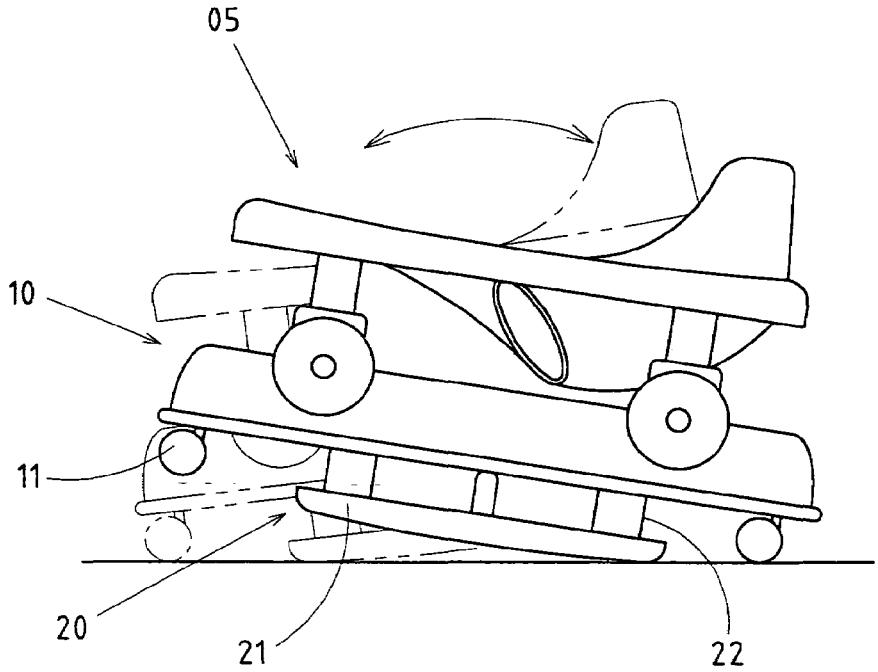
FIG. 8 shows a side schematic view of the preferred embodiment of the present invention in action on rockers.

The rockers 20 are formed of a curved rod 21 and two fastening tongues 22 extending in the same direction from two opposite ends of the curved rod 21. The two fastening tongues 22 have an elastic retaining block 23. The two rockers 20 are respectively engaged with two opposite side frames 12 of the base structure 10. The two side frames 12 are provided with two guide slots 13 corresponding to the two fastening tongues 22. The two guide slots 13 are provided with two retaining holes 31 and 32, which are arranged at an interval and are aligned with the elastic retaining block 23 of the tongues 23. Each rocker 20 is adjustably fastened to the side frame 12 such that the two tongues 22 of the curved rod 21 are received in the two guide slots 13, and that the elastic retaining block 23 of the tongues is retained in either the first retaining hole 31 or the second retaining hole 32. If the elastic retaining block 23 is retained in the first retaining hole 31, the curved rod 21 is located at a distance above a surface on which the wheels 11 rest, as illustrated in FIGS. 3, 4, and 7. As a result, the walker 05 is capable of a back-and-forth movement on wheels 11. If the elastic retaining block 23 is retained in the second retaining hole 32, the curved rod 21 comes in contact with the surface such that the wheels 11 are located a distance above the surface, as illustrated in FIGS. 5, 6, and 8. The walker 05 is therefore capable of a rocking movement on the rockers 20.

The curved rod 21 of the two rockers 20 is further provided with an auxiliary elastic retaining block 24 extending from the midpoint of the curved rod 21 in the same direction as the tongues 22. Accordingly, the two side frames 12 are provided with an auxiliary retaining hole 14 corresponding to the auxiliary elastic retaining block 24. As the curved rod 21 is engaged with the side frame 12 such that the elastic retaining blocks 23 of the tongues 22 of the curved rod 21 are retained in the first retaining holes 31 of the side frame 12, the auxiliary elastic retaining block 24 is retained in the auxiliary retaining hole 14 of the side frame 12, as illustrated in FIG. 3. However, the auxiliary elastic retaining block 24 is no longer retained in the auxiliary retaining hole 14 at the time when the rocker 20 are at work, as illustrated in FIGS. 5 and 8.

The two tongues 22 of the rockers 20 are further provided with a projection 25. The two guide slots 13 of the side frames 12 are further provided in the top wall thereof with a confinement through slot 40 of a predetermined length and having a first end 41 and a second end 42. When the rockers 20 are in a standby state, the projection 25 is located at the first end 41 of the confinement through slot 40, as shown in FIG. 3. On the other hand, when the rockers 20 are at work, the projection 25 is located at the second end 42 of the confinement through slot 40, as shown in FIG. 5. The projection 25 of the tongues 22 and the confinement through slots 40 of the side frames 12 are used to enhance the locating effect on the rockers 20.

The embodiment of the present invention described above is to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A walker used by babies to learn to walk comprising: a base frame support by a plurality of wheels, said base frame having a pair of rockers adjustably fastened thereto so as to allow the walker to have a rocking movement while on an underlying surface, said base frame having a pair of fastening portions opposite to each other, said pair of fastening portions adjustably fastening respectively said pair of rockers, said pair of fastening portions each having a guide slot, each of said pair of fastening portions having a first retaining hole and a second retaining hole in a top wall thereof, said first retaining hole aligned with said second retaining hole, each of said pair of rockers being formed of a curved rod with a pair of tongues extending in a same direction from opposite ends of said curved rod, said pair of tongues received by said guide slot, each of said pair of tongues having an elastic retaining block affixed thereto, the elastic retaining block being retained in said first retaining hole when the rocker is in a standby state, the elastic retaining block being retained in said second retaining hole when the rocker is at work.

2. The walker of claim 1, each of said pair of fastening portions of said base frame having an auxiliary retaining hole positioned between the guide slots, said curved rod having an auxiliary elastic retaining block positioned between said pair of tongues, said pair of rockers being adjustably fastened to said base frame such that said auxiliary elastic retaining block is releasably retained in said auxiliary retaining hole when said pair of rockers are in the standby state, said elastic retaining block being separated from said auxiliary retaining hole when said pair of rockers are at work.

3. The walker of claim 1, each of said pair of guide slots having a confinement slot, said confinement slot having a length with a first end and a second end, each of said pair of tongues having a projection, said projection located at said first end of said confinement slot when said pair of rockers are in the standby state, said projection located at said second end of said confinement slot when said pair of rockers are at work.

* * * * *